United States Patent [19]

Yamakawa

[11] 4,439,989

[45] Apr. 3, 1984

[54] INTERNAL COMBUSTION ENGINE PROVIDED WITH A PLURALITY OF POWER UNITS

[75] Inventor: Toru Yamakawa, Hachioji, Japan

[73] Assignee: Fuji Jukogyo Kabushiki Kaisha, Tokyo, Japan

[21] Appl. No.: 403,738

[22] PCT Filed: Nov. 30, 1981

[86] PCT No.: PCT/JP81/00362

§ 371 Date: Jul. 29, 1982

§ 102(e) Date: Jul. 29, 1982

[87] PCT Pub. No.: WO82/01916

PCT Pub. Date: Jun. 10, 1982

[51] Int. Cl.[3] ..... F02D 25/00; F02D 17/02; F02D 35/00; F02B 73/00

[52] U.S. Cl. ..... 60/718; 60/706

[58] Field of Search ..... 60/698, 706, 709, 718, 60/719

[56] References Cited

U.S. PATENT DOCUMENTS 1,636,050 7/1927 Fottinger ..... 60/718

2,527,424 10/1950 Johansson ..... 60/718

*Primary Examiner*—Allen M. Ostrager

*Attorney, Agent, or Firm*—Martin A. Farber

[57] ABSTRACT

An internal combustion engine comprising a primary engine unit and an auxiliary engine unit, in which a clutch of the auxiliary engine unit is engaged at a proper phase difference between both engine units.

3 Claims, 14 Drawing Figures

FIG. 3
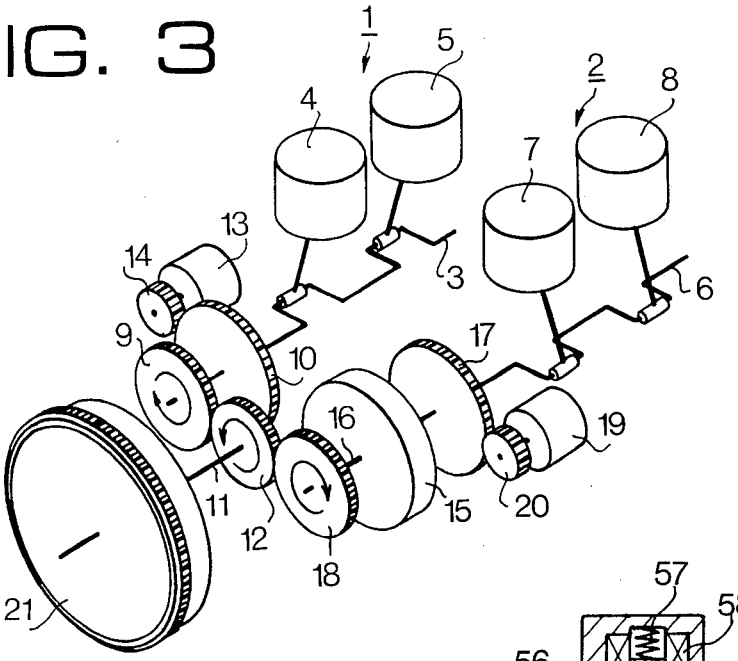
FIG. 4
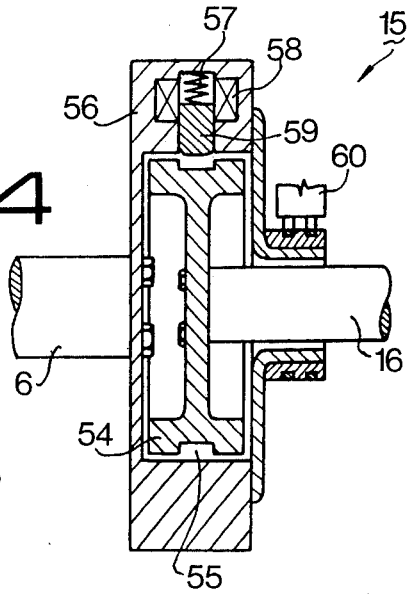
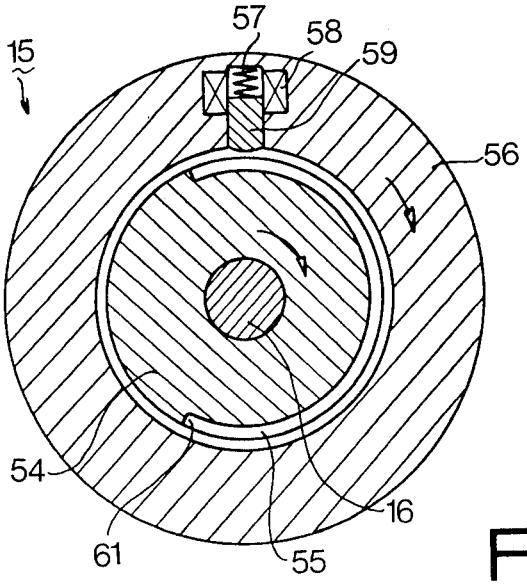
FIG. 5

FIG.10
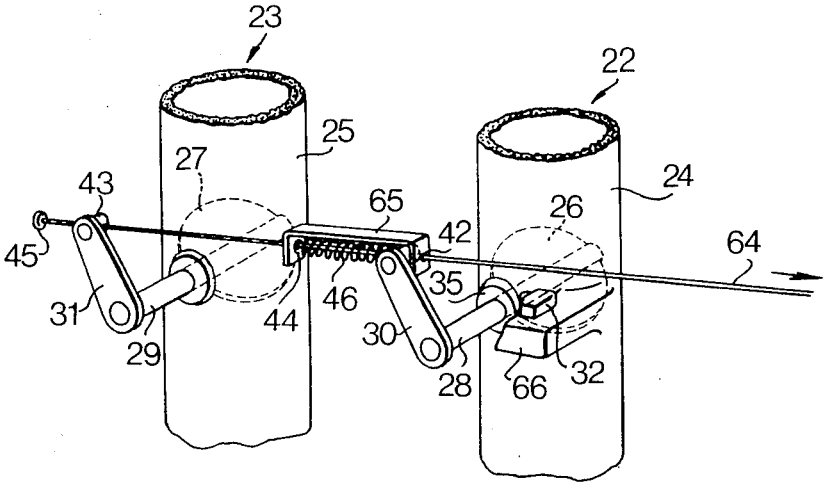
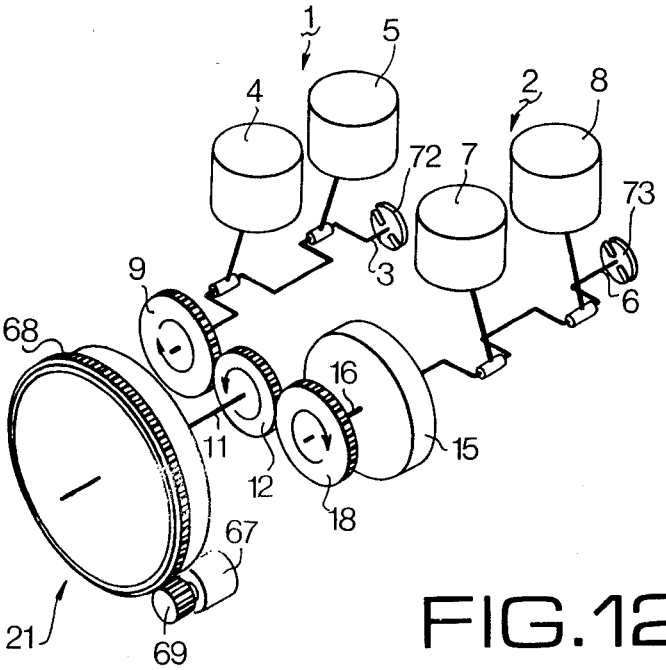
FIG.12

INTERNAL COMBUSTION ENGINE PROVIDED WITH A PLURALITY OF POWER UNITS

TECHNICAL FIELD

The present invention relates to an internal combustion engine provided with a plurality of independent engine units in which one or more engine units are selectively used in accordance with driving conditions of a vehicle driven by the engine.

BACKGROUND ART

It is preferable to design an engine for a constant load so that a desired torque may generate at a low specific fuel consumption. However, it is difficult to design an engine for driving vehicles so as to have low specific fuel consumption within the entire range of the engine operation, since load on the engine varies in a wide range.

FIG. 1 shows a fuel consumption characteristic of an engine for a vehicle at various specific fuel consumptions (g/ps.hr), in which the abscissa is engine speed (r.p.m), the ordinate is engine torque. Curve A shows running load (resistance) of a vehicle on a flat road. The curve A is decided by drag of the body of the vehicle and gear ratio of the transmission of the engine and the specific fuel consumption is decided by the performance of the engine. It is desirably to design the engine so that the curve A may pass through low fuel consumption zones.

DISCLOSURE OF THE INVENTION

The object of the present invention is to provide an engine assembly for a vehicle, which comprises with a plurality of independent engine units, one or more engine units of which are selectively operated in accordance with conditions of the engine operation, whereby the engine assembly is operated in low fuel consumption zones within a wide range of the engine operation.

The engine assembly of the present invention comprises at least two engine units, one of which is a primary engine unit and the other is an auxiliary engine unit. In a low torque range, the primary engine unit is operated, and in a high torque range, the primary and auxiliary units are co-operated to drive the vehicle in accordance with driving conditions of the vehicle.

FIG. 2 shows a fuel consumption characteristic of an engine assembly according to the present invention comprising two engine units. A fist zone C is characteristic of the primary engine unit and a second zone E is characteristic of the engine assembly in which the primary engine unit and auxiliary engine unit are combined. The fuel consumption characteristic of the second zone is the same as that of the conventional engine shown in FIG. 1 and the running load curve B is the same as the curve A. Since the curve B passes through a minimum fuel consumption zone D at a low torque operation as shown in FIG. 2, fuel consumption is improved. The auxiliary engine unit is adapted to be started and connected to the output system of the primary engine unit, when the combined power is necessary to drive the vehicle. In such an engine assembly, it is important to connect the auxiliary engine unit with the primary engine unit at a proper phase difference. If the phase of the auxiliary engine unit is not synchronized with the phase of the primary unit, the composite torque of the engine assembly fluctuates in a wide range, which causes an increase of engine vibration.

The present ivention provides a system which comprises means for detecting phases of the primary engine unit and auxiliary engine unit, means for synchronizing the operation of the auxiliary engine unit with the operation of the primary engine unit at a predetermined phase difference, preferably at 180 degrees phase difference, and means for connecting the output system of the auxiliary engine unit with the output system of the primary engine unit when both engine operations are sychronized at the phase difference.

According to an aspect of the present invention, phase detecting means comprises a phase detecting circuit for detecting ignition pulses of both engine units. According to another aspect of the present invention, phase detecting means is means for detecting phases of crankshafts of both engine units.

BRIEF DESCRIPTION OF THE DRAWINGS

FIG. 3 is a schematic perspective view of an engine assembly according to the present invention;

FIG. 4 is a sectional view of a clutch taken along the axial direction;

FIG. 5 is a sectional view of the clutch taken along the lateral direction;

FIG. 10 is a perspective view of another example of the carburetor assembly;

FIG. 12 is a perspective view showing another embodiment of the present invention;

BEST MODE FOR EMBODYING THE INVENTION

Figure 1:
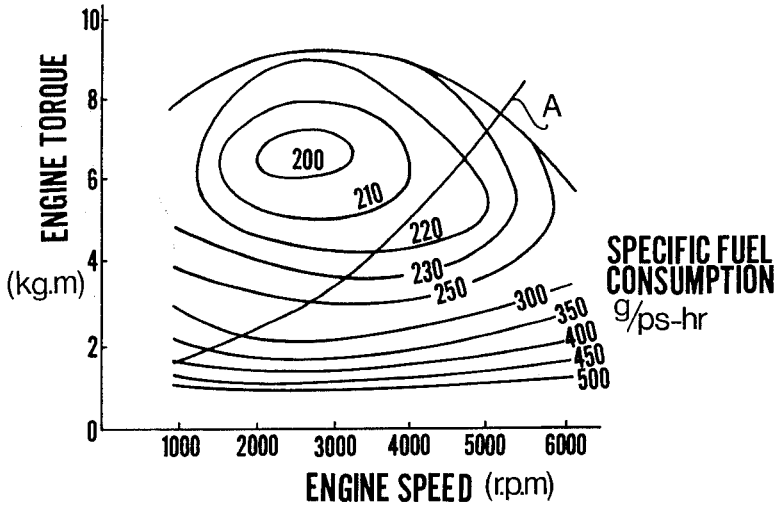
FIG. 1 is a graph showing a fuel consumption characteristic of a conventional engine.
Figure 2:
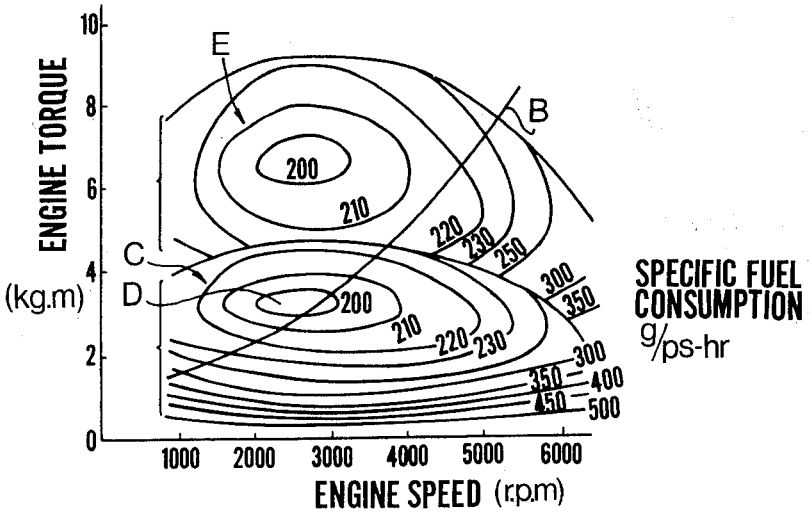
FIG. 2 is a graph showing a fuel consumption characteristic of an engine of the present invention.

The present invention will be explained in detail hereinafter with reference to FIGS. 3 to 7. The illustrated engine according to the present invention comprises a primary engine unit 1 of two-cylinder, an auxiliary engine unit 2 of two-cylinder.

Pistons 4 and 5 of the primary engine unit 1 are connected to a crankshaft 3 by connecting rods respectively, on the other hand, pistons 7 and 8 of the auxiliary engine unit 2 are connected to a crankshaft 6 by respective connecting rods. A power transmitting gear 9 and a starting gear 10 are securely mounted on the crankshaft 3, and the gear 9 engages with an output gear 12 secured to an output shaft 11. The starting gear 10 is engaged with a gear 14 of a starter 13. Securely mounted on the crankshaft 6 is a starting gear 17 which is engaged with a gear 20 of a starter 19. The crankshaft 6 is connected to a transmitting shaft 16 through an electromagnetic powder clutch 15. A transmitting gear 18 on the shaft 16 engages with the output gear 12. On the output shaft 11, a flywheel 21 provided with a clutch is securly mounted.

Figure 6:
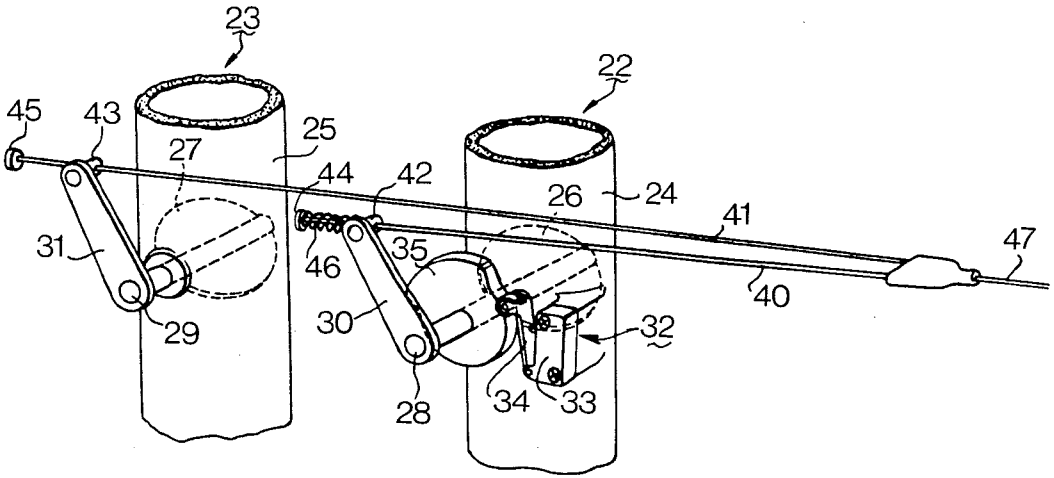
FIG. 6 is a schematic perspective view of a carburetor assembly used for the engine assembly.

Referring to FIG. 6, carburetors 22 and 23 for engine units 1 and 2 comprise parallel barrels 24 and 25, throttle valves 26 and 27 supported by throttle shafts 28 and 29, respectively. Levers 30 and 31 secured to throttle shafts 28 and 29 have pins 42 and 43 each having hole. A throttle position sensor 32 for detecting the timing of co-operation of engine units are provided in the carburetor 22. The throttle position sensor 32 comprises a cam 35 secured to the shaft 28 and a microswitch 33, an actuating lever 34 of which is engaged with the cam 35.

An accelerator wire 40 passes through the hole of the pin 42 and an accelerator wire 41 passes through the hole of the pin 43. Both wires are connected to a common wire 47 which is connected to an accelerator pedal (not shown). A spring 46 is provided between a flange 44 secured to the end of the wire 46 and the pin 42. A flange 45 is secured to the end of the wire 41.

Figure 7:
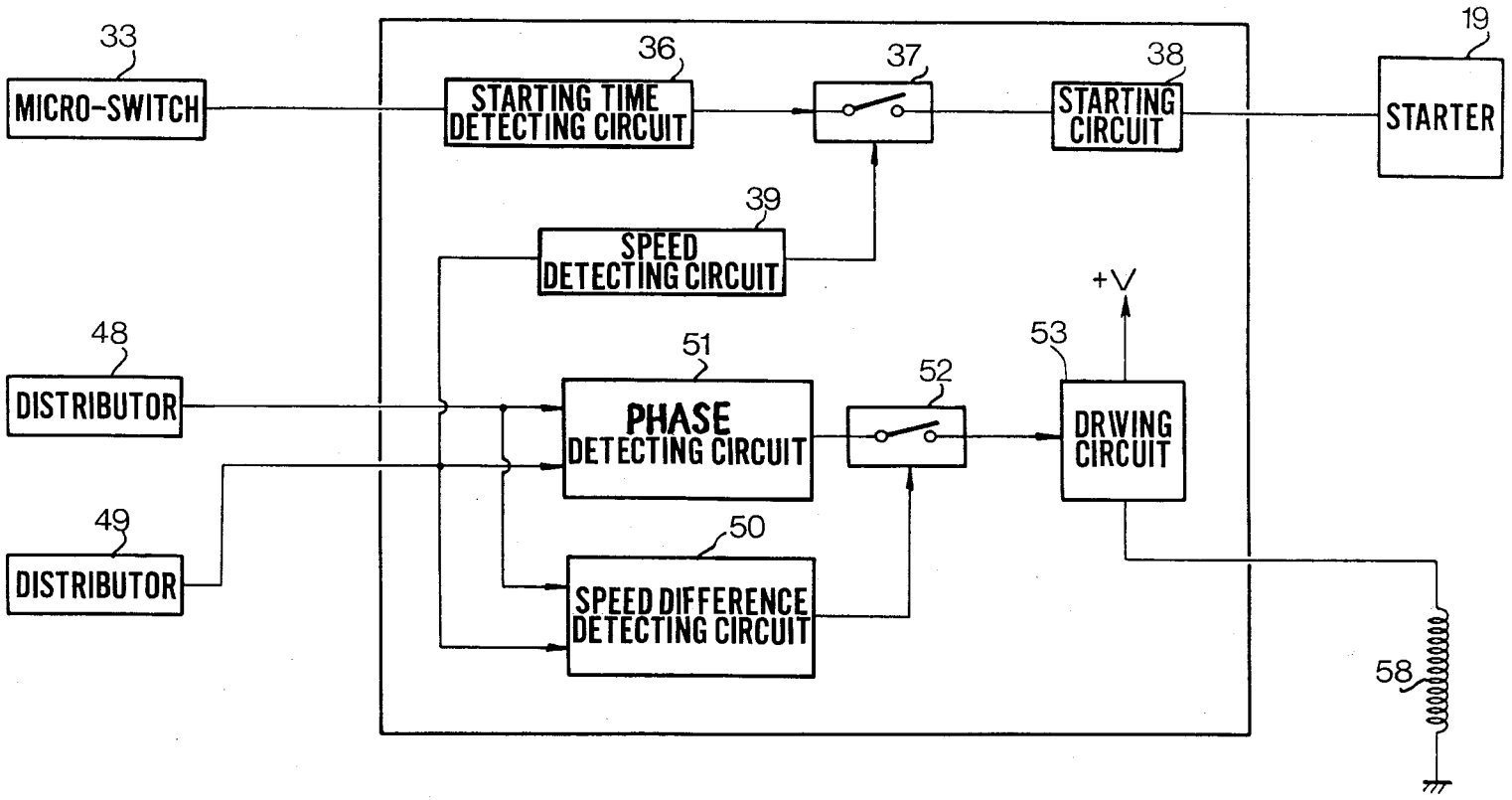
FIG. 7 is a block diagram showing a control system in the engine assembly.
Figure 8A:
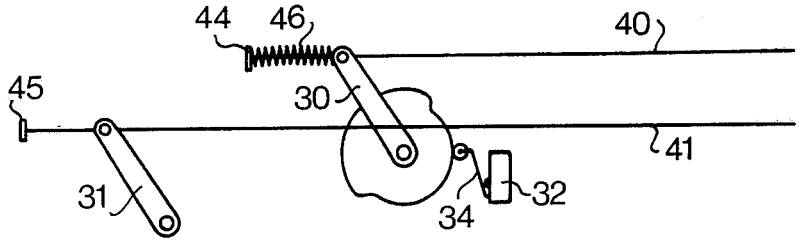
FIG. 8 is a schematic illustration showing operation of the carburetor assembly.
Figure 8B:
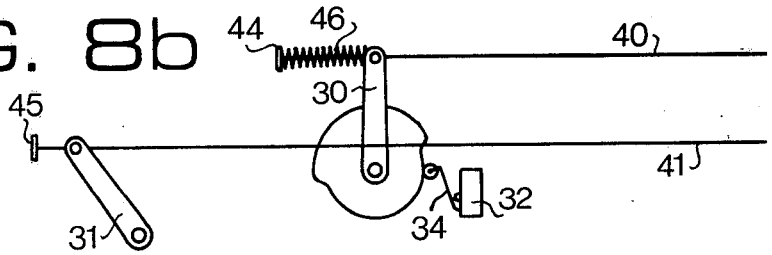
Figure 8C:
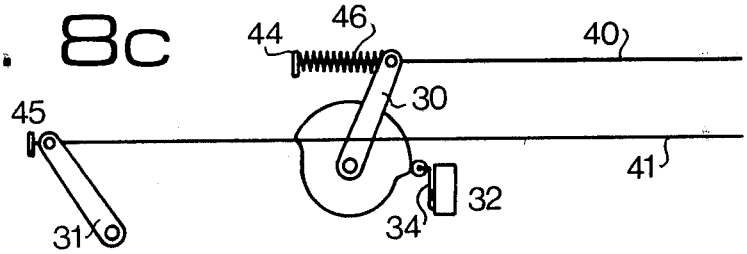
Figure 8D:
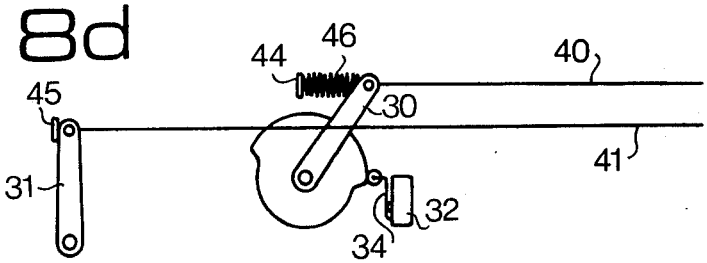

Referring to FIG. 7, the output of the microswitch 33 is connected to a starting time detecting circuit 36. The output of the starting time detecting circuit 36 is connected to the starteer 19 through a normally closed switch 37 and a starting circuit 38. A distributor 48 for the primary engine unit 1 and a distributor 49 for the auxiliary engine unit 2 produce ignition pulses respectively. Ignition pulses of the distributor 48 are applied to a speed difference detecting circuit 50 and to a phase detecting circuit 51 and ignition pulses of the distributor are applied to a speed detecting circuit 39 and to circuits 50 and 51. The output of the speed detecting circuit 39 is connected to the gate of the switch 37. The speed detecting circuit 39 is adapted to produce an output signal, when the engine speed of the auxiliary engine unit 2, which corresponds to the frequency of the ignition pulse, exceeds a predetermined value.

The speed difference detecting circuit 50 compares the ignition pulse frequency fed from the distributor 49 of the auxiliary engine unit with the ignition pulse frequency from the distributor 48 of the primary engine unit 48 and produces an output signal, when the difference decreases below a predetermined value. The output of the speed difference detecting circuit 50 is applied to a gate of a switch 52. The phase detecting circuit 51 produces an output signal, when the phase difference between both engine units reaches within a predetermined range. The output of the circuit 51 is applied through the switch 52 to a driving circuit 53 for the clutch 15.

It is difficult to coincide the phase difference between both engine units to a predetermined value. In order to eliminate such a difficulty, the clutch 15 is so arranged as to adjust the phase of the auxiliary engine unit by means of mechanical device. More particularly, as shown in FIGS. 4 and 5, the electromagnetic powder clutch 15 comprises a driven member 54 secured to the transmitting shaft 16, a drive member 56 secured to the crankshaft 6, surrounding the driven member 54. An engaging groove 55 is provided on the periphery of the driven member 54 within a predetermined peripheral range. A radially arranged lock pin 59 is slidably engaged in a hole of the drive member 56 and biased by a spring 57 to the engaging groove 55. The lock pin 59 is held in a retracted position by the attracting force caused by an electromagnetic coil 58. The coil 58 is supplied with electric power through brushes 60. The engaging groove 55 is so arranged that when the lock pin 59 abuts on an end 61 of the groove, the auxiliary engine unit 2 is at the predetermined phase difference in relation to the phase of the primary engine unit 1.

In operation, when the starter 13 is operated, the primary engine unit 1 is started. At that time, since no signal is fed to the driving circuit 53, so that the clutch 15 is disengaged.

During low engine torque operation, the electromagnetic clutch 15 is disengaged and the fuel consumption characteristic is shown by the first time zone C and the running load curve B passes through the minimum fuel consumption zone D. Thus, fuel consumption of the engine is low.

When the accelerator pedal is depressed, the accelerator wire 40 and 41 move to the right in FIG. 8(*a*). Since the flange 44 engages with the lever 30 through the spring 46 and the flange 45 does not engage with the lever 31, only the primary engine unit 1 is accelerated or decelerated (FIG. 8(*b*).

In a high engine torque operation, when the accelerator pedal is deeply depressed the microswitch 33 is closed by the cam 35 (FIG. 8(*c*). The output of the microswitch 33 is applied to the starting circuit 38 via starting time detecting circuit 36 and switch 37. The starting circuit 38 produces an output, so that the starter 19 is operated. At the same time, an ignition circuit (not shown) is operated. Thus, the auxiliary engine unit 2 is started at a proper time. When the speed of the auxiliary engine unit 2 exceeds a predetermined value, the speed detecting circuit 39 produces an output signal, so that the switch 37 is opened, thereby to stop the operation of the starter 19. Further depression of the accelerator pedal increases the speed of the auxiliary engine unit 2 (FIG. 8 (*d*).

The difference between speeds of both engine units decreases below a predetermined value, the speed difference detecting circuit 50 produces an output signal which closes the switch 52. On the other hand, the phase difference between both engine operations reaches to a value within a predetermined range, the phase detecting circuit 51 produces an output signal which is fed to the driving circuit 53 via switch 52. The driving circuit 53 operates to supply a small current to a magnetizing coil of the electromagnetic powder clutch 15 to cause a partial engagement state of the clutch and further operates to cut off the circuit for the coil 58 for de-energizing the coil. Thus, the lock pin 59 is projected and engaged with the groove 55 by the spring 57. When the pin 59 engages with the end 61 of the groove 55, the phase detecting circuit 51 produces a coincide signal which causes the driving circuit 53 to operate to supply a rated current to the electromagnetic clutch 15. Thus, the auxiliary engine unit 2 is connected to the output shaft 11.

Figure 9:
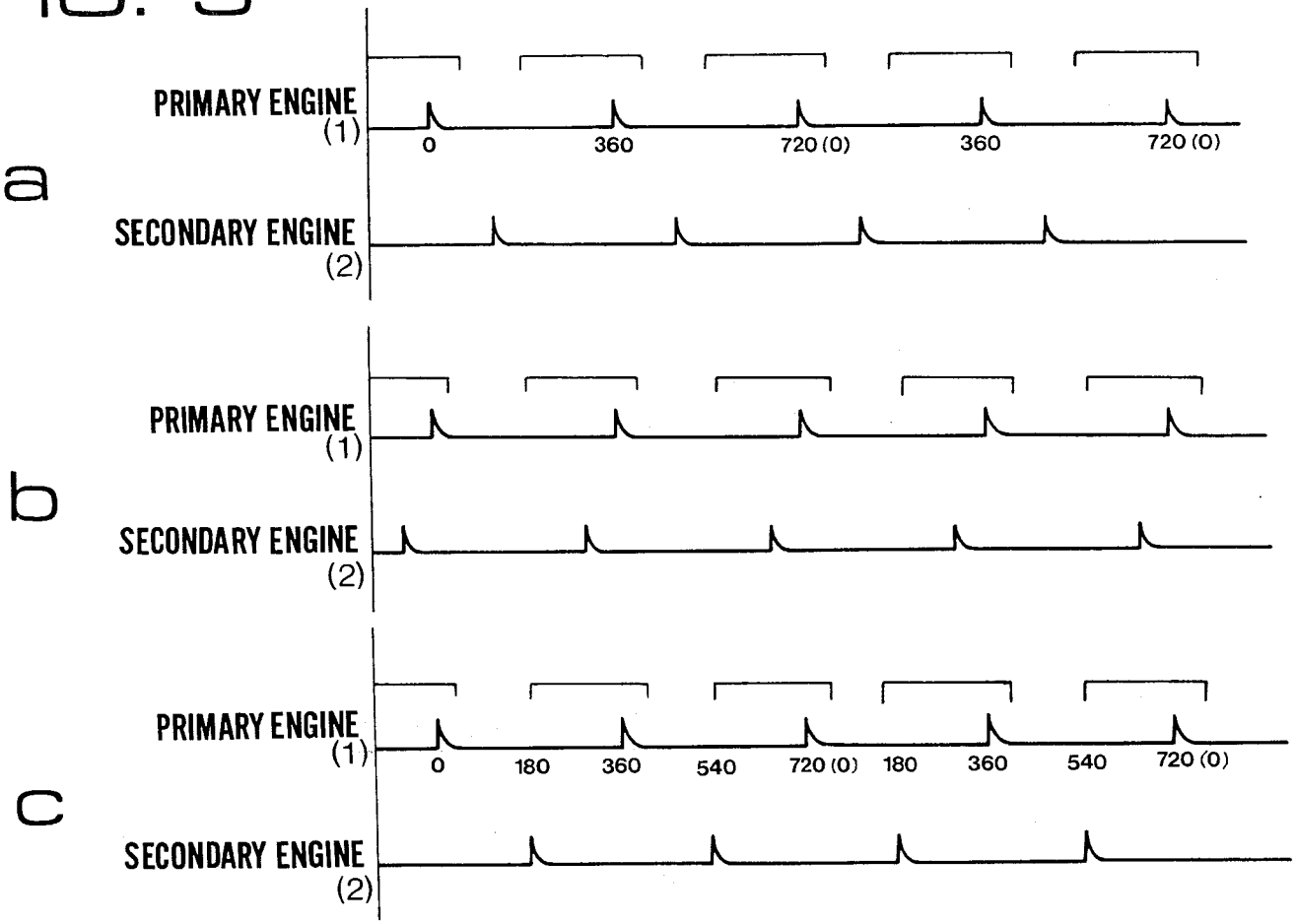
FIG. 9 is an illustration for explaining relationship between ignition pulses of a primary engine unit and an auxiliary engine unit.
Figure 11A:
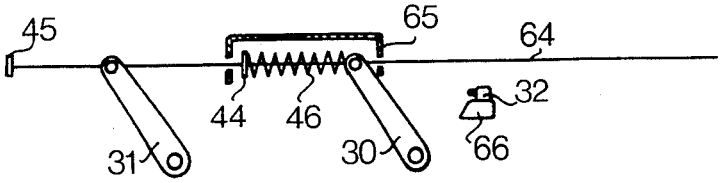
FIG. 11 is a schematic illustration showing operation of the carburetor assembly of FIG. 10.
Figure 11B:
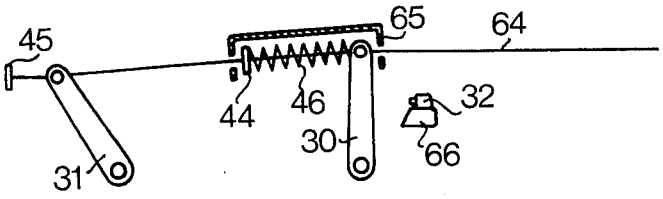
Figure 11C:
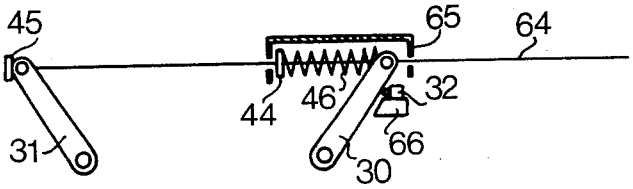
Figure 11D:
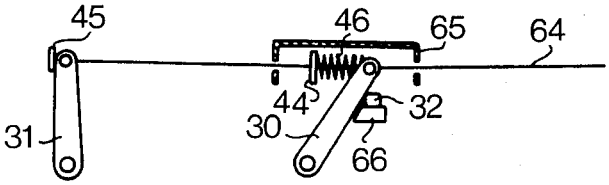

FIG. 9 (*a*) shows a state where the phase difference between ignition pulses of both engine units is out of a predetermined allowable range, FIG. 9 (*b*) shows a state in which the phase difference is in the range, and FIG. 9 (*c*) shows a state that the phase difference is in 180 degrees phase difference, which is the co-operating state of both engine units.

When the accelerator pedal is released for deceleration of the engine assembly and the flange 45 moves to the left from the position of FIG. 8(*c*), the speed of the auxiliary engine unit 2 decreases below the speed of the primary engine unit 1. Thus, the output of the speed difference detecting circuit 50 goes to a low level, so that the switch 52 is opened. Therefore, electromagnetic powder clutch 15 is disengaged and the coil 58 is energized to retract the lock pin 59. Thus, the auxiliary engine unit becomes inoperative.

Referring to FIG. 10 showing another example of carburator assembly, the carburetor assembly is operated by only one accelerator wire 64. A compression spring 46 is provided between the pin 42 and the flange 44, and a frame 65, is slidably engaged with the wire 64 at opposite sides of the flange 44 and pin 42. The microswitch 32 is provided on a support 66.

When the accelerator pedal is depressed, the accelerator wire 64 moves to the right in FIG. 11 (*a*). Since the flange 44 engages with the lever 30 through the spring 46 and the flange 45 does not engage with the lever 31, only the primary engine unit 1 is accelerated or decelerated.

In a large engine torque operation, the accelerator pedal is deeply depressed, so that the lever 30 engages with the support 66 on the other hand, the flange 45 engages the lever 31. When the accelerator pedal is further depressed, the spring 46 is compressed by the flange 44 and only the lever 31 is rotated by the flange 45 as shown in FIG. 11(*d*). Thus, the auxiliary engine unit 2 is accelerated.

Figure 13:
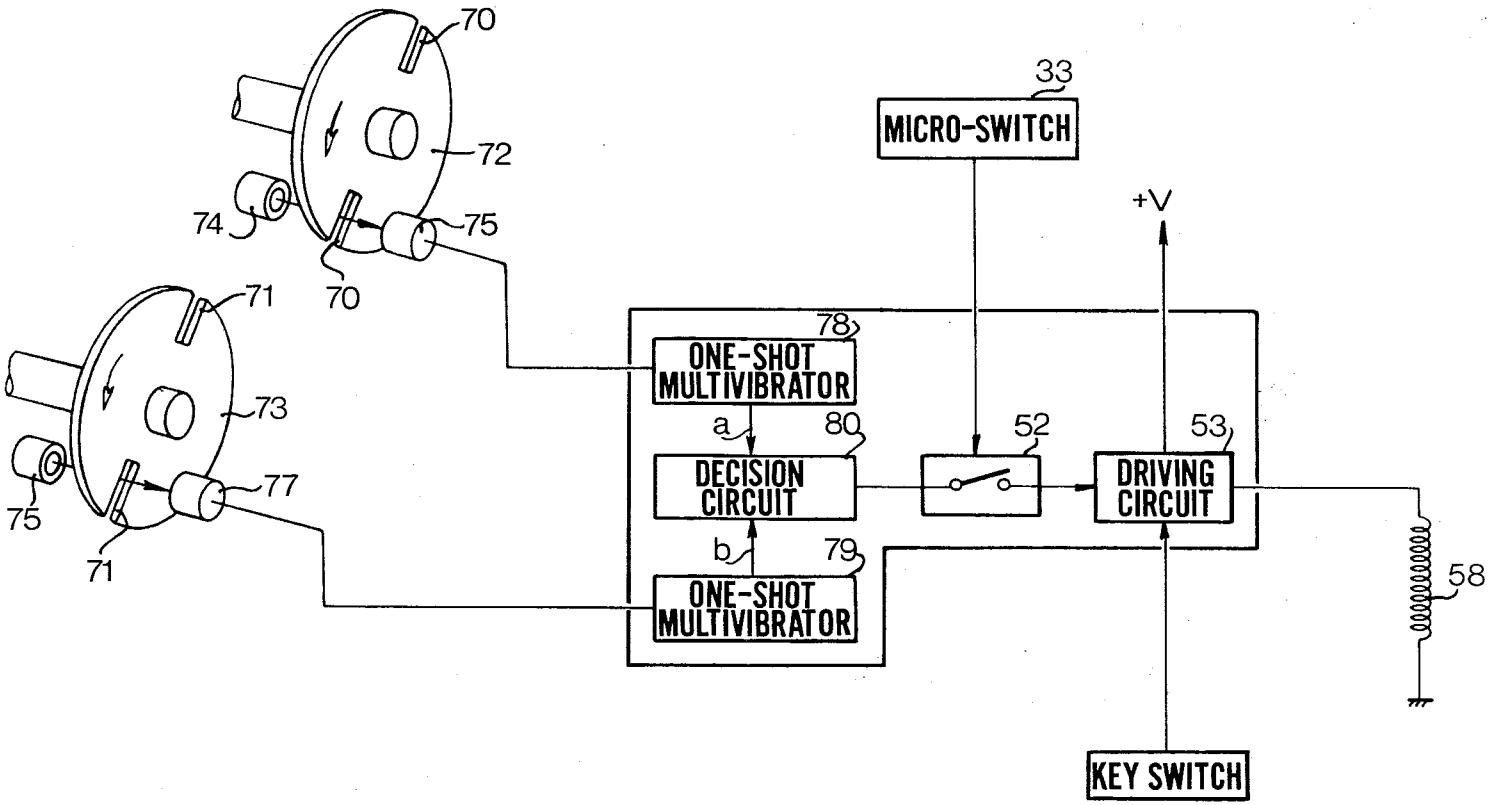
FIG. 13 is a block diagram showing a control system of the embodiment of FIG. 12.
Figure 14:
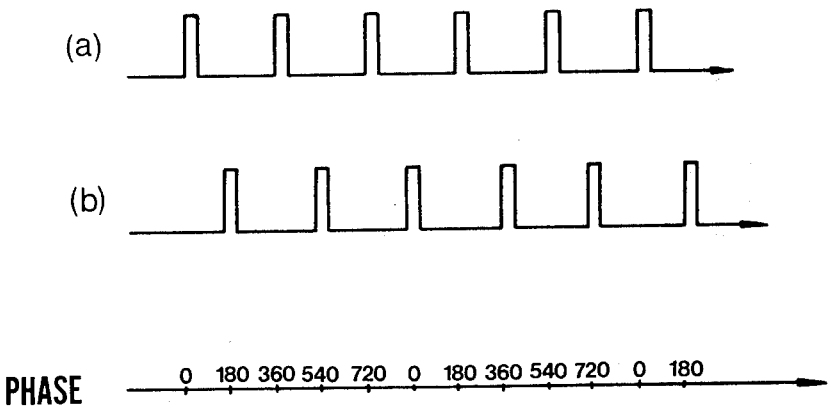
FIG. 14 is an illustration showing a relationship between ignition pulses.

Referring to FIGS. 12 and 13 showing another embodiment of the present invention, the engine assembly employs the carburetor assembly shown in FIG. 10. In the engine assembly, one starter 67 is provided to start the primary engine unit 1. A pinion 69 of the starter 67 is engaged with a gear 68 formed on the flywheel 21. In the system, the electromagnetic clutch 15 is engaged by the operation of the driving circuit 53. Therefore when the primary engine unit 1 is started, which is initiated by the turning of the key switch, the auxiliary engine unit 2 is also started. After starting of the auxiliary engine unit, the clutch is disengaged by the operation of the driving circuit 53. On end portions of both crankshafts 3 and 6, disks 72 and 73 having opposite slits 70, 71 are securely mounted in phase. Light-emitting elements 74 and 75 are disposed adjacent to disks 72 and 73, respectively, and light-sensitive elements 76 and 77 are disposed on opposite side of each disk in alignment with respective light-emitting element. In this embodiment, the switch 52 is closed by the output of the microswitch 33.

Outputs of both light-sensitive elements 76 and 77 are applied to one-shot multivibrators 78 and 79. Under the condition of the closing of the switch 52 in high engine torque operation, when the phase difference between outputs of one-shot multivibrators 78 and 79 reaches to a predetermined value, a decision circuit 80 produces an output signal. The signal is fed to the driving circuit 53 via the switch 52. Thus, the electromagnetic powder clutch 15 is engaged in a similar manner to the previous embodiment. Therefore, the auxiliary engine unit is connected to the output shaft 11.

When the engine speed decreases and the microswitch 33 is opened, the clutch 15 is disengaged. Thus, only the primary engine unit 1 operates to produce the output.

PROBABILITY OF INDUSTRIAL EXPLOITATION

The engine assembly according to the present invention comprises at least one primary engine unit and one auxiliary engine unit, the primary engine unit is connected to an output shaft and the auxiliary engine unit is connected to the output shaft through a clutch, and further comprises a control system including detecting means for detecting phase difference between both engine operations. The control system operates to connect the clutch when phase difference reaches to a predetermined preferable value. Therefore, the auxiliary engine is connected to the output system of the primary engine unit without fluctuation of the engine torque, which ensures a stable operation of the engine assembly.

I claim:

1. An internal combustion engine for a vehicle, which comprises a plurality of independent engine units including a primary engine unit and an auxiliary engine unit, and an output shaft, characterized in that the primary engine is connected to the output shaft and the auxiliary engine unit is connected to the output shaft through a clutch, that a control system is provided with means for detecting phase difference between both engine units and for engaging the clutch at a proper phase difference.

2. An internal combustion engine for a vehicle according to claim 1 wherein said means for detecting phase difference is provided to detect phase difference between ignition timings of both engine units.

3. An internal combustion engine for a vehicle according to claim 1 wherein said means for detecting phase difference is provided to detect phase difference between rotations of crankshafts of both engine units.

* * * * *